US005519974A

United States Patent [19]

Greenberg

[11] Patent Number: 5,519,974

[45] Date of Patent: May 28, 1996

[54] STANDING SEAM ROOFING PANEL

[75] Inventor: Percy Greenberg, St. Louis Park, Minn.

[73] Assignee: Crown Partnership, Anoka, Minn.

[21] Appl. No.: 293,095

[22] Filed: Aug. 19, 1994

[51] Int. Cl.[6] ..... E04D 1/00

[52] U.S. Cl. ..... 52/518; 52/522; 52/537; 52/542

[58] Field of Search ..... 52/518, 522, 537, 52/542

[56] References Cited

U.S. PATENT DOCUMENTS

| | | | |
|---|---|---|---|
| 3,481,094 | 12/1969 | Taylor | 52/522 X |
| 4,091,588 | 5/1978 | Heirich | 52/542 X |
| 4,114,340 | 9/1978 | Dean et al. | 52/522 X |
| 4,133,161 | 1/1979 | Lester | 52/537 X |
| 4,269,012 | 5/1981 | Mattingly et al. | 52/542 X |
| 4,495,743 | 1/1985 | Ellison et al. . | |
| 4,522,007 | 6/1985 | Oehlert | 52/522 X |
| 4,580,384 | 4/1986 | Hutcheson | 52/537 |
| 4,700,522 | 10/1987 | Simpson | 52/542 X |
| 4,987,716 | 1/1991 | Boyd | 52/537 X |
| 5,012,623 | 5/1991 | Taylor | 52/537 X |
| 5,140,793 | 8/1992 | Knudson . | |
| 5,201,158 | 4/1993 | Bayley et al. | 52/537 |
| 5,247,772 | 9/1993 | Greenberg . | |

*Primary Examiner*—Wynn E. Wood
*Attorney, Agent, or Firm*—Nawrocki, Rooney & Sivertson

[57] ABSTRACT

Standing seam roofing system including first and second dikes integral with opposite longitudinal edges of a panel, and a roof connection ledge connected to the first dike and extending in the plane of the panel. The second dike snaps over the first dike on an adjacent panel in a manner to leave a gap between the ledge and the second dike panel, and includes a downwardly extending and inwardly sloped leg. A lip on the second dike extends under a base on the first dike of the adjacent panel, the lip position being maintained by a pinching action or force produced by the slope of the downwardly extending leg.

10 Claims, 2 Drawing Sheets

STANDING SEAM ROOFING PANEL

BACKGROUND OF THE INVENTION

1. Field of the Invention

The present invention relates to standing seam roofing systems and, more particularly, to clipless standing seam roofing panels.

2. Description of the Prior Art

Standing seam roofing systems are well known in the art and are in common use, particularly in commercial constructions. In a typical standing seam roofing system, the opposite edges of the roof-forming panels are folded or bent to form a dike. The dikes of adjacent panels define a raised or standing seam. The standing seam prevents water seepage from the surface of the roofing panels to the roofing materials beneath the panels providing a dryer roofing structure, while directing water and other elements toward the edge of the roof.

Standing seam roofing panels are typically joined and secured to the roofed surface by a clip. Typical clips include a base which is secured to the surface to be roofed, as by screwing or nailing, and clipping wings which are folded over the upstanding edges/dikes of adjacent roofing panels. Each clip is secured to the surface to be roofed between the dikes of adjacent panels. A cap covers the standing seam between adjacent panels to seal the roofed surface at the seam.

Examples of prior art references showing standing seam roofing panel systems include U.S. Pat. Nos. 5,140,793 and 4,495,743. These patents discuss the value of standing seam roofing assemblies and show various constructions of the assemblies. However, they fail to recognize or to overcome the problems inherent in the use of clips or similar securing devices.

U.S. Pat. No. 5,247,772, issued Sep. 28, 1993, for STANDING SEAM ROOFING PANEL to the inventor of the invention described herein, which patent is co-owned with the present invention and which is hereby incorporated herein, in its entirety, by reference, describes a clip-free joinder of dike members of adjacent panels. Thus, the problems inherent in the use of a plurality of clips or other connectors as required in the system of the earlier references are eliminated. However, in the construction of the incorporated patent, the upper surface of the cap covering of the seams is not parallel to the body of the panel. This can result in a differing appearance between panel and seam and, in some constructions, from seam to seam.

SUMMARY OF THE INVENTION

The present invention provides an improved standing seam roofing panel having the advantages of the system of the incorporated patent. Elevated ridges along first and second opposed panel sides define dikes which form a standing seam between adjacent roofing panels. A ledge is integrally formed with the panel and extends from a first dike to its associated edge at the first panel side. The ledge is used to secure the panel to a roofing surface, as by screwing or nailing, for example. A cap is formed integrally with a second dike and has a free end which is secured over the first dike of an adjacent roofing panel to secure the second side of the panel to the roofed surface and seal the seam between them. Accordingly, when first and second dikes of adjacent panels are arranged to form a roofing construction, the ledge (and any fastening devices, such as screws) of one panel is covered by the adjacent panel, while the cap of the adjacent panel seals the standing seam between them. Thus, there is provided a roofing construction having all of the advantages of prior art standing seam roofs, but which eliminates the need for separate clips and seam caps.

In accordance with the present invention, the portion of the cap covering the seam is formed of a surface generally parallel to the body of the panel. Accordingly, there is a greater uniformity in appearance from seam to seam—and seam to panel. In the disclosed embodiment, the cap is formed of a first upstanding dike forming leg, a second leg extending from, and generally perpendicular to, the first leg and over the seam between adjacent panels and a third leg sloping downwardly and toward the first leg. The downward slope of the third leg provides a "pinching" action which maintains engagable members of adjacent panels in operative relation.

DETAILED DESCRIPTION OF THE PREFERRED EMBODIMENTS

Figure 1:
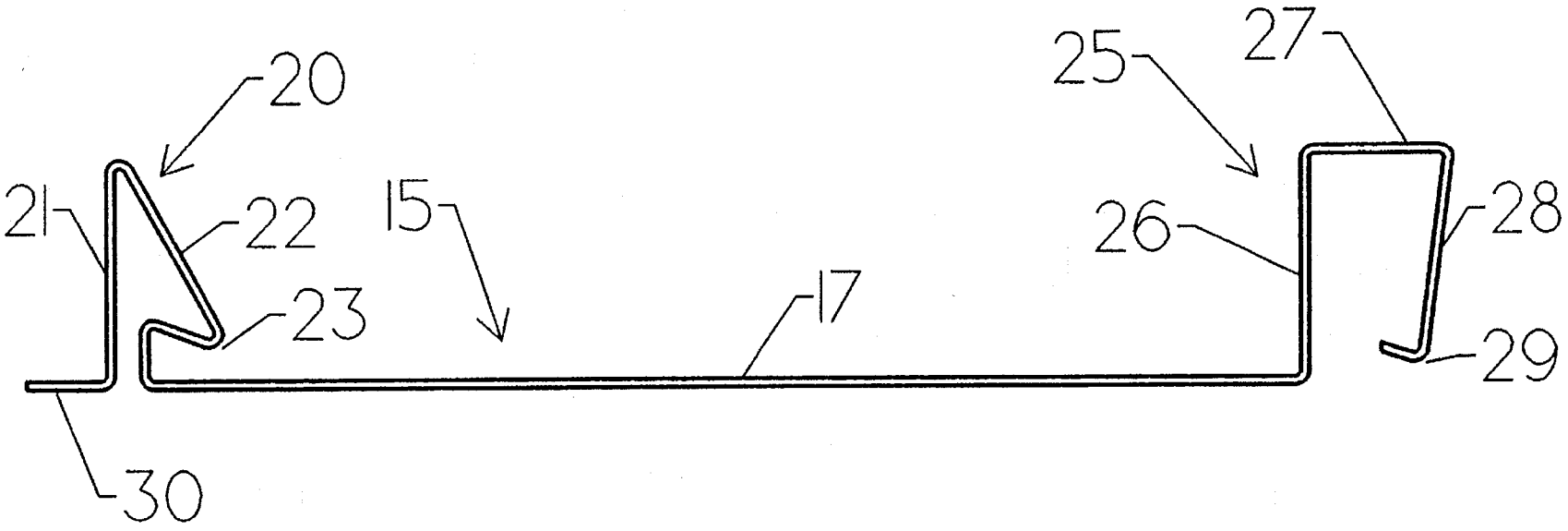
FIG. 1 is a plan end view showing a standing seam roofing panel in accordance with the present invention.

FIG. 1 shows a roofing panel assembly indicated generally at 15. Assembly 15 includes a panel 17. Along one longitudinal edge of panel 17 is a first upwardly extending interconnect member or dike indicated generally at 20. Dike 20 includes a leg 21 extending at approximately a right angle to panel 17. Another leg 22 of dike 20 slopes downwardly from the top of leg 21, and away from the leg 21 to a connector portion or base 23 from which it extends toward leg 21 at an upwardly extending angle. Leg 22 joins panel 17 at a portion generally parallel to leg 21. A plate or ledge 30 extends from the bottom of leg 21 in generally the same plane as panel 17. As described in the incorporated patent, ledge 30 caries a plurality of holes or slots (not shown) for receiving fastening devices, such as screws 35 (see FIG. 2), for securing assembly 15 to a roof. In a preferred embodiment, the fastening holes are elongated to accommodate thermal expansion of the panel.

At an opposite longitudinal edge of panel 17, there is shown a second interconnect member or dike indicated generally at 25. Dike 25 includes leg 26 extending at substantially a right angle to panel 17. The height (extension from panel 17) of leg 26 is selected to be shorter than that of leg 21 of first interconnect member 20, for reasons set out in the incorporated patent and described more fully below. The top of leg 26 is connected to an outwardly extending leg 27 which lies in a plane generally parallel to and spaced from panel 17. Another leg 28 is connected to the end of leg 27 and slopes downwardly toward panel 17 at an angle directed inwardly toward leg 26. A second connector portion or lip 29 is carried at the lower end of leg 28, the second connector portion 29 being adapted to cooperate with portion 23 of an adjacent panel assembly to form a snap connection in a manner more fully described below.

Figure 2:
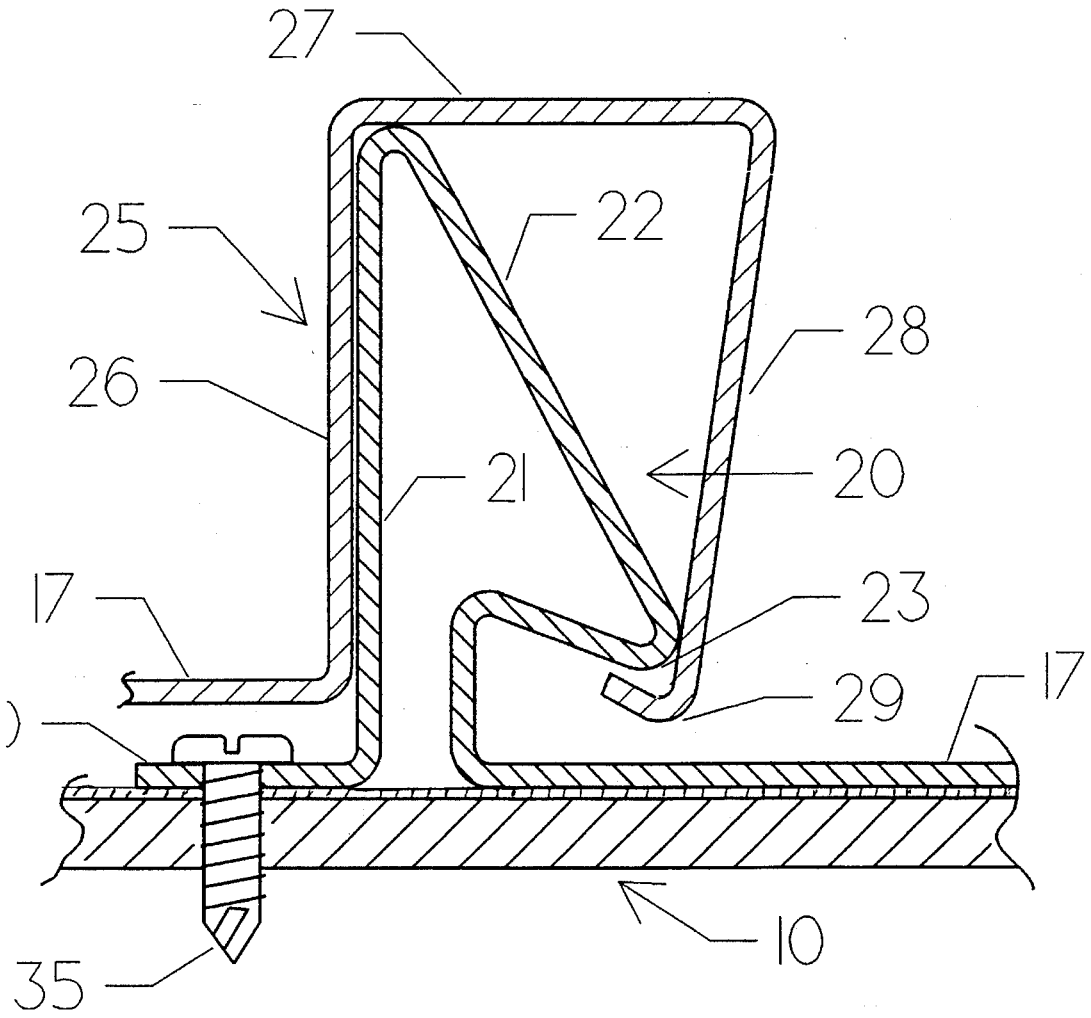
FIG. 2 is a partial sectional view showing the interconnection of first and second dike members of adjacent roofing panels, the panels being constructed as shown in FIG. 1.

In practice, adjacent panel assemblies 15 are interconnected by placing female-acting interconnect member 25 over male-acting interconnect member 20 in the manner of a cap, as shown in FIG. 2. In FIG. 2, a panel 17 having a first (male) interconnect member 20 is shown connected to a roof (including a layer of construction paper, if desired) indicated generally at 10 by a plurality of fasteners such as screw 35 which extend through ledge 30. Note that in FIG. 2 screw 35 is shown with a head extending above the plane of ledge 30.

An adjacent panel 17 is also shown in FIG. 2. This second panel 17 carries the second (female) interconnect device 25 which is shown extending over the first interconnect device 20 (and the gap between the legs 21 and 26) to be securely maintained in place by the "snap" coaction of members 29 and 23. In this clip-free manner of installation of roofing assemblies 15 it can be seen that leg 21 has been chosen to be longer than leg 26 to assure the presence of a gap between ledge 30 and overlying panel 17 great enough to prevent the heads of screws 35 from touching and "reading through" (and perhaps damaging) panel 17. The downward slope of leg 28 toward leg 21 (i.e., and acute angle between legs 27 and 28) provides a pinching action maintaining leg 28 against connector portion 23 with connector portion 29 extending below connector portion 23. The length of leg 28 and the extension of connector portion 29 are selected such that portion 29 can "clear" connector 29 with leg 27 remaining generally parallel to panel surface 17. During installation, leg 22 acts as a camming surface to spread leg 28 from leg 21 until connector 29 passes (clears) connector 23. At this point, leg 28 will "snap" against base 23 with lip 29 lying under base 29.

The importance of the above described gap between ledge 30 and panel 17 was recognized and described in the incorporated patent by the inventor of this invention. In the system of the incorporated patent, in order to assure a strong, positive snap connection given the different lengths of legs 21 and 26, a leg such as leg 27 of FIG. 2 is caused to extend from a leg such as 25 at an upwardly directed (obtuse) angle. Also in the system of the incorporated patent, a leg such as leg 28 of FIG. 2 extends downwardly and approximately perpendicularly to panel 17 and parallel to leg 21. By exerting pressure on the upwardly angled leg of the incorporated patent, connectors such as 23 and 29 can be brought into engagement. However, this prior connection had certain disadvantages, such as an aesthetically unpleasant variation of appearance from surface to surface dependent on the order in which the roofing assemblies were laid on the roof.

To overcome this disadvantage and achieve adequate holding strength and ease of connection, a preferred embodiment of this invention configures leg 27 generally parallel to panel 17 but provides a small angle between downwardly extending leg 28 and the perpendicular (an acute angle between leg 27 and leg 28). In the illustrated embodiment, this offset from perpendicular is selected to be between approximately 5 and 7 degrees. This small angle will cause snap lips 29 on leg 28 to ride on sloped leg 22 from a downward pressure on cap 25, until the bottom of the slope of leg 22 is reached (at base 23) at which point lip 29 will snap into position under base 23. The result is a secure connection between the first and second dikes 20 and 25, and the maintenance of a gap of preferably about 0.135 inches between ledge 30 and adjacent panel 17. Further, the parallel (to panel 17) leg 27 will present a more pleasing appearance to the assembled roofing panels. It should be noted that in the secured position illustrated in FIG. 2, the end of the lip 29 lies below the lower edge of snap base 23. This allows the lip 29 to extend below the snap base 23 under the urging of the "pinch" action produced by the angle of leg 28 relative to leg 21—the lip 29 engages the snap base 23 in response to any force acting to lift the cap 25 from the member 20.

In the figures of the drawings and in the preferred embodiments, the various legs and other features of members 20 and 25 are integrally formed. Further, members 20 and 25 are preferably integral with and formed from panel 17 to create one panel assembly 15. Assembly 15 is preferably made of a galvanized or painted steel or aluminum which has been anodized or painted or any other suitable material—copper, for example. In at least one form of the preferred embodiment of FIGS. 1 and 2, it has been found that the distance between legs 21 and 26 in FIG. 1 (the width of panel surface 17) preferably ranges between approximately 9.50 and 29.50 inches. The preferable height of leg 21 has been placed at approximately 1.5 inches, while the lesser height of leg 26 has been placed at approximately 1.375 inches.

Having thus described the preferred embodiments of the present invention, those of skill in the art will readily devise other useful embodiments within the scope of the appended claims.

What is claimed is:

1. In a roofing assembly including a panel having a generally planar body, first and second assembly interconnect means mounted on opposing longitudinal edges of the panel, the first interconnect means being adapted to cooperate with the second interconnect means on an adjacent assembly to form a standing seam, the improvement for providing a standing seam having an upper surface generally parallel to the panel body comprising:

the first interconnect means having a first leg extending upwardly and generally perpendicular to the panel, and a second leg sloping downwardly and away from the first leg and terminating in a first connector portion, the first interconnect means including ledge means for securing the panel to a surface to be roofed; and the second interconnect means having a first leg extending upwardly and generally perpendicular to the panel and forming an outer standing seam surface, a second leg extending generally perpendicular to the first leg and being spaced from and generally parallel to the panel body, and a third leg sloping downwardly and toward the first leg and terminating in a second connector portion, the first and second connector portions being adapted to cooperate to hold adjacent panels together when the first interconnect means on one panel is interconnected with the second interconnect means on an adjacent panel.

2. The roofing assembly of claim 1 including means for providing a gap between the ledge means and an overlying adjacent panel.

3. The roofing assembly of claim 1 wherein the first interconnect means first leg is longer than the second interconnect means first leg.

4. The roofing assembly of claim 1 wherein the second interconnect means third leg slopes toward the second interconnect means first leg at an angle in the range of 5 to 7 degrees.

5. Standing seam roofing assembly comprising:

a roofing panel having a panel body and first and second opposite longitudinal edges;

male interconnect means integral with the panel first edge and including a first vertically extending leg and a second leg sloping downwardly and away from the first leg and terminating in a snap connector base means;

female interconnect means integral with the panel second edge and including a first vertically extending leg forming an outer standing seam surface, a second leg extending perpendicular to the first leg and being spaced from and generally parallel to the panel body, and a third leg sloping downwardly and toward the first leg and terminating in snap connector lip means, the female interconnect means being adapted to receive the male interconnect means of an adjacent panel such that the lip means underlies the snap connector base means; and roof securing ledge means integral with the male interconnect means for mounting the roofing panel to a roof.

6. The standing seam roofing assembly of claim 5 wherein the panel body adjacent the female interconnect means of one panel is adapted to cover, while being spaced from the male means, integral roof securing ledge means of an adjacent panel.

7. The apparatus of claim 6 wherein the female interconnect means first leg is shorter than the male interconnect means first leg.

8. The apparatus of claim 7 in which the female interconnect means third leg slopes at an angle of between 5 and 7 degrees from the vertical.

9. The apparatus of claim 6 in which the female interconnect means third leg slopes at an angle of between 5 and 7 degrees from the vertical.

10. The apparatus of claim 5 in which the female interconnect means third leg slopes at an angle of between 5 and 7 degrees from the vertical.

* * * * *